US010184270B2

(12) United States Patent
Bullwinkel

(10) Patent No.: US 10,184,270 B2
(45) Date of Patent: Jan. 22, 2019

(54) LOCKING DEVICE FOR PRODUCT DISPLAY HOOKS, SHOWCASES, CABINETS, FIXTURES, AND CASEWORK

(71) Applicant: Delta Lock Company, LLC, Bohemia, NY (US)

(72) Inventor: William H. Bullwinkel, Farmingdale, NY (US)

(73) Assignee: Delta Lock Company, LLC, Bohemia, NY (US)

( * ) Notice: Subject to any disclaimer, the term of this patent is extended or adjusted under 35 U.S.C. 154(b) by 9 days.

(21) Appl. No.: 15/238,955

(22) Filed: Aug. 17, 2016

(65) Prior Publication Data

US 2016/0356058 A1 Dec. 8, 2016

Related U.S. Application Data

(63) Continuation of application No. 14/607,595, filed on Jan. 28, 2015, now Pat. No. 9,435,144.

(60) Provisional application No. 61/932,268, filed on Jan. 28, 2014.

(51) Int. Cl.

| | |
|---|---|
| ***E05B 21/06*** | (2006.01) |
| ***E05B 67/36*** | (2006.01) |
| ***E05B 73/00*** | (2006.01) |
| ***E05B 65/06*** | (2006.01) |
| *A47F 5/08* | (2006.01) |

(52) U.S. Cl.

CPC ..... *E05B 21/06* (2013.01); *E05B 65/06* (2013.01); *E05B 67/36* (2013.01); *E05B 73/00* (2013.01); *A47F 5/0861* (2013.01); *Y10T 70/7486* (2015.04); *Y10T 70/7576* (2015.04)

(58) Field of Classification Search

CPC ..... A47F 5/0861; A47F 5/08; Y10T 70/7486; Y10T 70/50; Y10T 70/5004; Y10T 70/7576; Y10T 70/7582; E05B 67/36; E05B 21/06; E05B 73/00; E05B 65/06

USPC ..... 70/232, 387, 14, 57, 57.1, 58, 32–34, 70/360, 361, 49, 461, 462, 95, 99, 100, 70/43, DIG. 62, DIG. 20, DIG. 27, 70/DIG. 36; 211/4, 7, 54.1, 57.1, 59.1; 248/551–553

See application file for complete search history.

(56) References Cited

U.S. PATENT DOCUMENTS

| | | | |
|---|---|---|---|
| 1,342,728 | A | 6/1920 | Welch |
| 1,539,301 | A | 5/1925 | Cooper |
| 1,965,336 | A | 7/1934 | Fitzgerald |

(Continued)

FOREIGN PATENT DOCUMENTS

| | | |
|---|---|---|
| WO | WO8300353 | 2/1983 |

*Primary Examiner* — Lloyd A Gall

(74) *Attorney, Agent, or Firm* — Gerald E. Hespos; Michael J. Porco; Matthew T. Hespos

(57) ABSTRACT

Locking devices that may be used with product display hooks, cabinets, and drawers are provided. A locking device according to one implementation comprising a housing and a shell. The housing includes an outer wall that defines an interior. The housing further includes a channel extending at least partially through the interior of the housing. The shell includes a projection. The shell is at least partially disposed within the interior of the housing and is moveable in a longitudinal direction within the interior of the housing. In an unlocked position, the projection is biased away from the first channel. In a locked position, the projection is maintained in the first channel.

17 Claims, 12 Drawing Sheets

(56) References Cited

U.S. PATENT DOCUMENTS 2,032,821 A 3/1936 Waits
3,340,709 A 9/1967 Callahan
3,696,647 A 10/1972 Balicki
3,726,115 A 4/1973 Wellekens
3,863,475 A * 2/1975 Foss ..... E05B 13/105 70/360
3,933,015 A 1/1976 Balicki
4,009,599 A 3/1977 Patriquin
4,418,554 A 12/1983 Wolfgang
4,476,699 A 10/1984 Dahlborg
4,565,080 A 1/1986 Kincaid
4,793,163 A 12/1988 MacFarlane
4,899,563 A 2/1990 Martin
4,920,774 A 5/1990 Martin
5,038,589 A 8/1991 Martin
5,121,619 A 6/1992 Martin
5,127,244 A 7/1992 Myers
5,255,544 A * 10/1993 Wu ..... B60R 25/0225 70/209
5,345,794 A 9/1994 Jenks
5,492,206 A 2/1996 Shieh
5,499,518 A 3/1996 Shieh
5,657,652 A 8/1997 Martin
5,722,275 A * 3/1998 Price ..... E05B 13/105 70/360
5,737,950 A 4/1998 Yun-Bin
5,819,889 A * 10/1998 Shieh ..... E05B 67/36 188/265
5,913,907 A 6/1999 Lee
6,035,673 A 3/2000 Harrison
6,092,402 A 7/2000 Porcelli
6,920,770 B2 7/2005 Lurie et al.
7,308,809 B2 * 12/2007 Lu ..... E05B 73/0082 70/14
RE41,188 E * 4/2010 Lurie ..... E05B 9/086 70/100
7,695,031 B2 * 4/2010 Jackson, Jr. ..... E05B 1/0038 292/169
7,716,958 B2 5/2010 Martin
7,849,720 B2 12/2010 Reese
7,874,189 B2 1/2011 Martin
7,918,111 B2 4/2011 Uliano
8,028,555 B2 10/2011 Lurie
8,646,297 B2 2/2014 Foti
8,776,557 B2 7/2014 Wang
8,919,156 B1 12/2014 Liu
8,978,426 B2 3/2015 Wang
9,167,918 B2 10/2015 Leyden
9,435,144 B2 * 9/2016 Bullwinkel ..... E05B 67/36
2001/0045114 A1 * 11/2001 Sokurenko ..... E05B 9/08 70/370
2005/0011237 A1 1/2005 Lurie
2005/0011239 A1 1/2005 Lurie et al.
2005/0241348 A1 11/2005 Devecki
2005/0279894 A1 12/2005 Sedon
2006/0157431 A1 7/2006 Nagelski
2007/0175246 A1 * 8/2007 Hsai ..... B60D 1/065 70/57
2009/0071209 A1 3/2009 Lurie
2010/0031717 A1 2/2010 Lurie et al.
2010/0212371 A1 8/2010 Foti
2013/0105419 A1 * 5/2013 Kologe ..... A47F 5/0861 211/7
2014/0013813 A1 * 1/2014 Le ..... E05C 1/14 70/344
2014/0298869 A1 10/2014 Wang
2015/0176307 A1 * 6/2015 Bullwinkel ..... E05B 27/005 70/382

* cited by examiner

LOCKING DEVICE FOR PRODUCT DISPLAY HOOKS, SHOWCASES, CABINETS, FIXTURES, AND CASEWORK

CROSS-REFERENCE TO RELATED APPLICATIONS

The present application is a continuation application of U.S. application Ser. No. 14/607,595, filed Jan. 28, 2015, now U.S. Pat. No. 9,435,144, which claims the benefit of Provisional Application No. 61/932,268, filed Jan. 28, 2014, the entire contents of which are incorporated by reference herein.

TECHNICAL FIELD

The present disclosure relates generally to devices and systems for preventing unauthorized removal of goods from a product display, fixture or the like, and more particularly, a locking device for product display hooks, showcases, cabinets, casework, and fixtures with doors, drawers and sliding doors.

BACKGROUND

Conventionally, items of merchandise are commonly displayed for sale on long protruding rods supported from a support structure in the nature of a peg board, a slat board, or a wire rack. These protruding rods are commonly referred to in the art as display hooks, peg board hooks, or slat board hooks. Similar rods may also protrude from a wire display rack for the same purpose.

The rods may come in a variety of shapes and sizes. For example, FIG. 1A illustrates a display hook or peg hook 10 formed from a single wire 12 with a single bend 14 at one end 16, while FIG. 1B illustrates a similar peg hook 10 with a ball end 18. The other end 20 of the peg hook 10 is configured to be coupled to a peg board (not shown).

In another example as shown in FIG. 1C, display hooks or peg hooks 22, 24 are formed of wire and are provided with upper and lower outwardly extending wire arms 26, 28, respectively. The upper arm 26 mounts a label holder 30 for holding a label that includes pricing and other product information, while the lower arm 28 is a display hook or peg hook. After the peg hook 10, 22, 24 is coupled to the peg board or other support structure, consumer goods or items are slid onto the wire 12 or lower arm 28 for display. Typically, merchandise can be packaged in or mounted on cardboard, plastic, or other material capable of supporting the weight of the merchandise. The packaging materials may include a hole, slot, or opening, generally near the top of the packaging, to receive the projecting wire of the display hook or peg hook 10, 22, 24. In this way, the merchandise hangs down from the wire 12 or lower arm 28 and is clearly displayed and easily removed by customers.

In a further example, FIG. 1D illustrates a double wire peg hook 32, also known as a loop hook or display hook. In this example, a single wire 34 is configured in an elongated U-shape forming one loop or bend 36 at one end 38. The other end 40 includes two free ends 42, 44 of the U-shaped wire 34, which are configured to mate with a respective support structure, such as a peg board, slat board, etc. For use with the loop hook 32, the item or merchandise is typically packaged in or mounted on cardboard, plastic, or other material with an elongated slot or opening configured to accept the bend 36 of the peg hook 32.

Items of merchandise may also be displayed and stored behind doors, drawers, showcases, cabinets, casework, and sliding doors in store fixtures.

Usually, hanging merchandise is relatively small but may be expensive, such as batteries, small tools, jewelry, cosmetic products, health care products, electronics and other high theft items. Such merchandise may be a target for shoplifters because of its relatively small size and easy accessibility. A shoplifter may be able to easily and quickly remove the items hanging from a display hook or displayed in unlocked showcase doors, drawers, or sliding doors, and then attempt to leave the store without being detected.

Therefore, a need exists for devices and systems that prevent the easy removal of items of merchandise, such as small expensive items, from display hooks, showcases, cabinets, casework, and fixtures with doors, drawers, and sliding doors.

SUMMARY

A locking device for product display hooks, showcase doors, drawers, and sliding doors is provided.

A locking device according to one embodiment comprises an outer housing, which includes an outer wall and a hollow cylindrical interior, the hollow cylindrical interior having a first longitudinal axis. The outer housing further includes a first channel extending from at least one aperture in the outer wall to the interior of the outer housing, wherein the first channel traverses the first longitudinal axis. The locking device further comprises a cylindrical shell including a projection. The cylindrical shell is at least partially disposed in the interior of the outer housing and moveable within the interior along the first longitudinal axis. The locking device also includes a cylinder plug having a key hole and tumblers. The cylinder plug is rotatably contained within the cylindrical shell. Additionally, the locking device includes a barrel spring at least partially contained within the interior of the outer housing. The barrel spring is configured to bias the projection of the cylindrical shell away from the first channel to an unlocked position. The first channel is configured to receive a wire to be locked, and, in the locked position, the projection is extended into the first channel and maintained in the first channel to secure the wire.

According to another embodiment, the present disclosure provides a locking device that comprises an outer housing, a shell, and a barrel spring. The outer housing has an opening to an interior of the outer housing. The outer housing further includes a first channel extending from at least one aperture in a wall of the outer housing to the interior of the outer housing. The shell has a projection and is disposed through the opening of the outer housing and longitudinally moveable within the interior of the outer housing. The barrel spring is at least partially contained within the interior of the outer housing. The barrel spring is configured to bias the projection of the shell away from the first channel to an unlocked position. In a locked position, the projection of the shell is maintained in the first channel.

The present disclosure also describes an embodiment of a locking device comprising a housing and a shell. The housing includes an outer wall defining an interior and further including a channel extending at least partially through the interior of the housing. The shell includes a projection and is at least partially disposed within the interior of the housing and moveable in a longitudinal direction within the interior of the housing. In an unlocked position, the projection is biased away from the first channel, and, in a locked position, the projection is maintained in the first channel.

In yet another embodiment, a push (or plunger type) actuated lock is provided. The push actuated lock of the present disclosure may be coupled to multiple peg styles including, but not limited to: single wire with bend of multiple angles, single wire with bend of multiple angles with ball end, double wire with bend of multiple angles, double wire with bend of multiple angles with ball end, etc. The "push type" display lock of the present disclosure is designed with easy slip-off and slip-on features and can be placed back on the display hook and locked after the key has been removed from the lock. The push actuated display hook lock includes changeable keyed cores with up to 400 different key numbers.

In another embodiment, the push actuated lock of the present disclosure may be employed with a locking plate in various applications such as for a showcase door, drawer and sliding door of a store fixture.

BRIEF DESCRIPTION OF THE DRAWINGS

The above and other aspects, features, and advantages of the present disclosure will become more apparent in light of the following detailed description when taken in conjunction with the accompanying drawings in which.

It should be understood that the drawings are for purposes of illustrating the concepts of the disclosure and are not necessarily the only possible configuration for illustrating the disclosure.

DETAILED DESCRIPTION

Preferred embodiments of the present disclosure will be described hereinbelow with reference to the accompanying drawings. In the following description, well-known functions or constructions are not described in detail to avoid obscuring the present disclosure in unnecessary detail.

Figure 2:
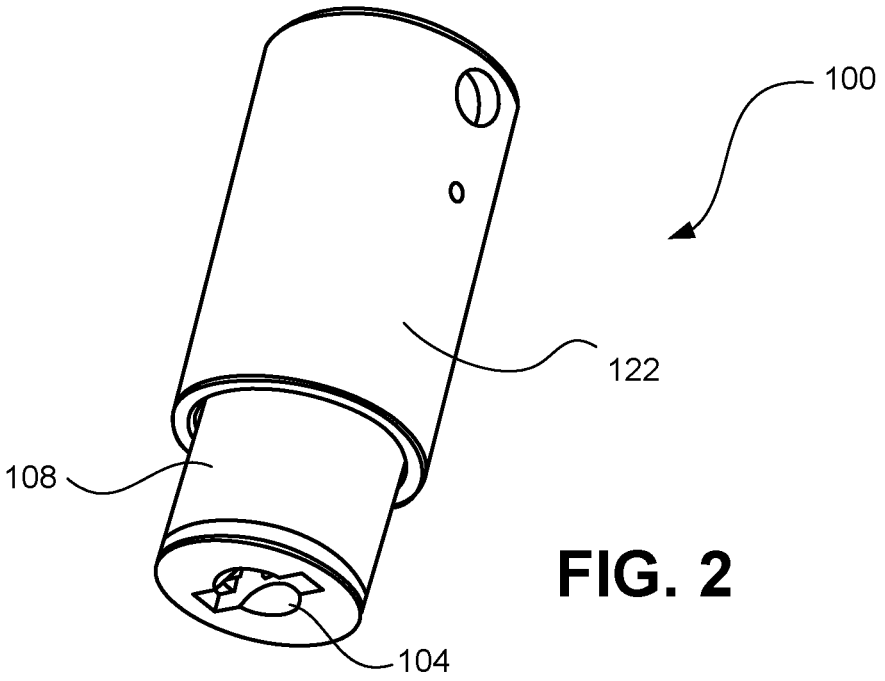
FIG. 2 is a perspective view of a locking device for securing a single wire peg hook in accordance with an embodiment of the present disclosure.
Figure 3:
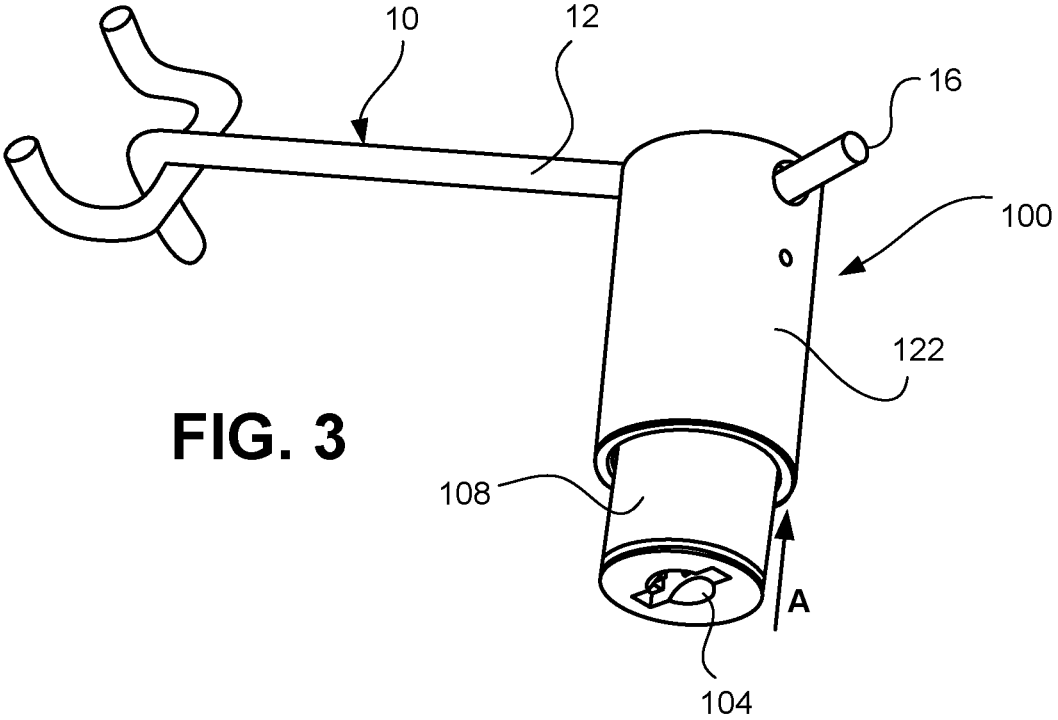
FIG. 3 illustrates the locking device of FIG. 2 coupled to a peg hook in accordance with an embodiment of the present disclosure.
Figure 4:
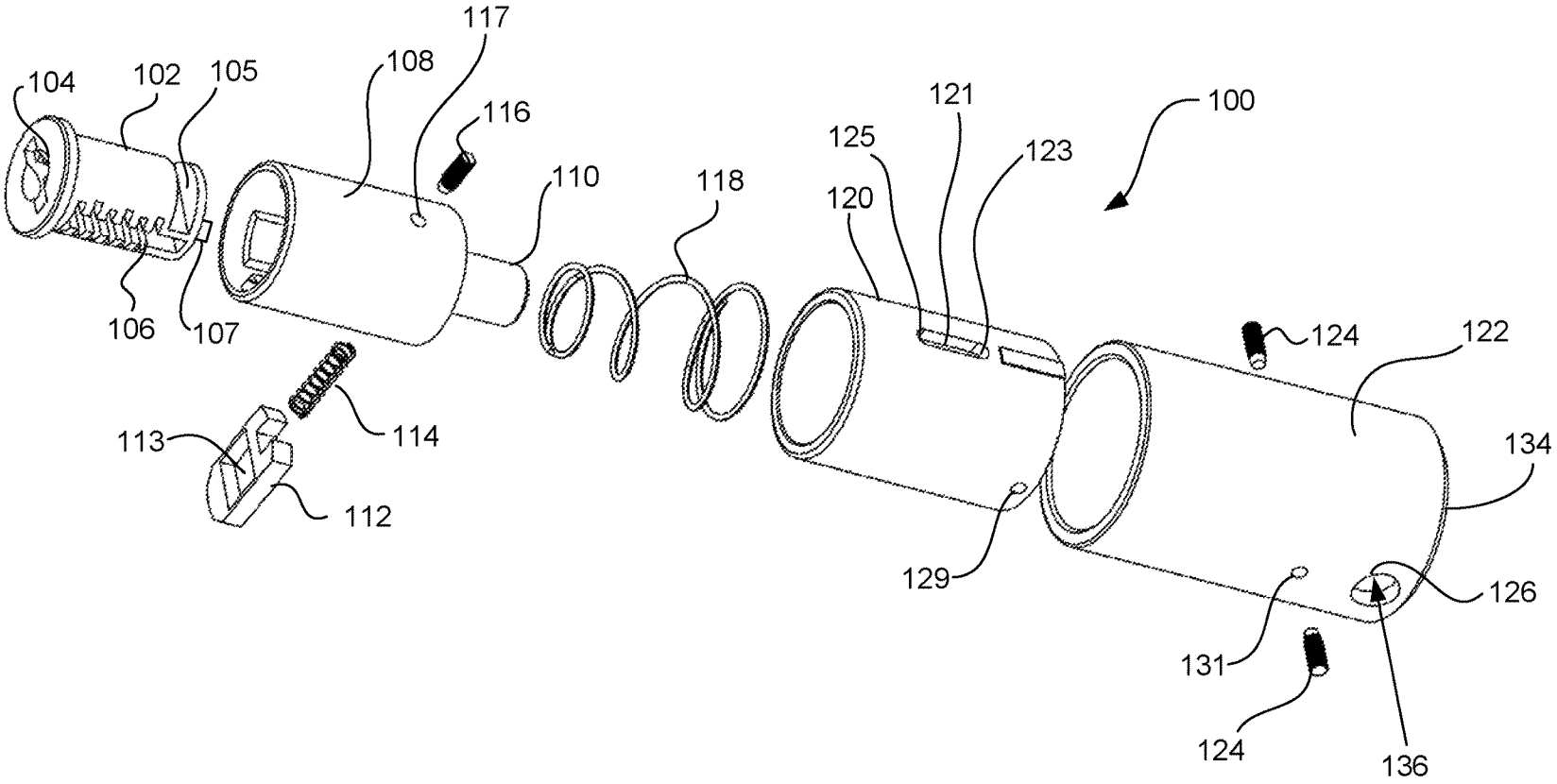
FIG. 4 is an exploded top perspective view of the locking device of FIG. 2 in accordance with an embodiment of the present disclosure.
Figure 5:
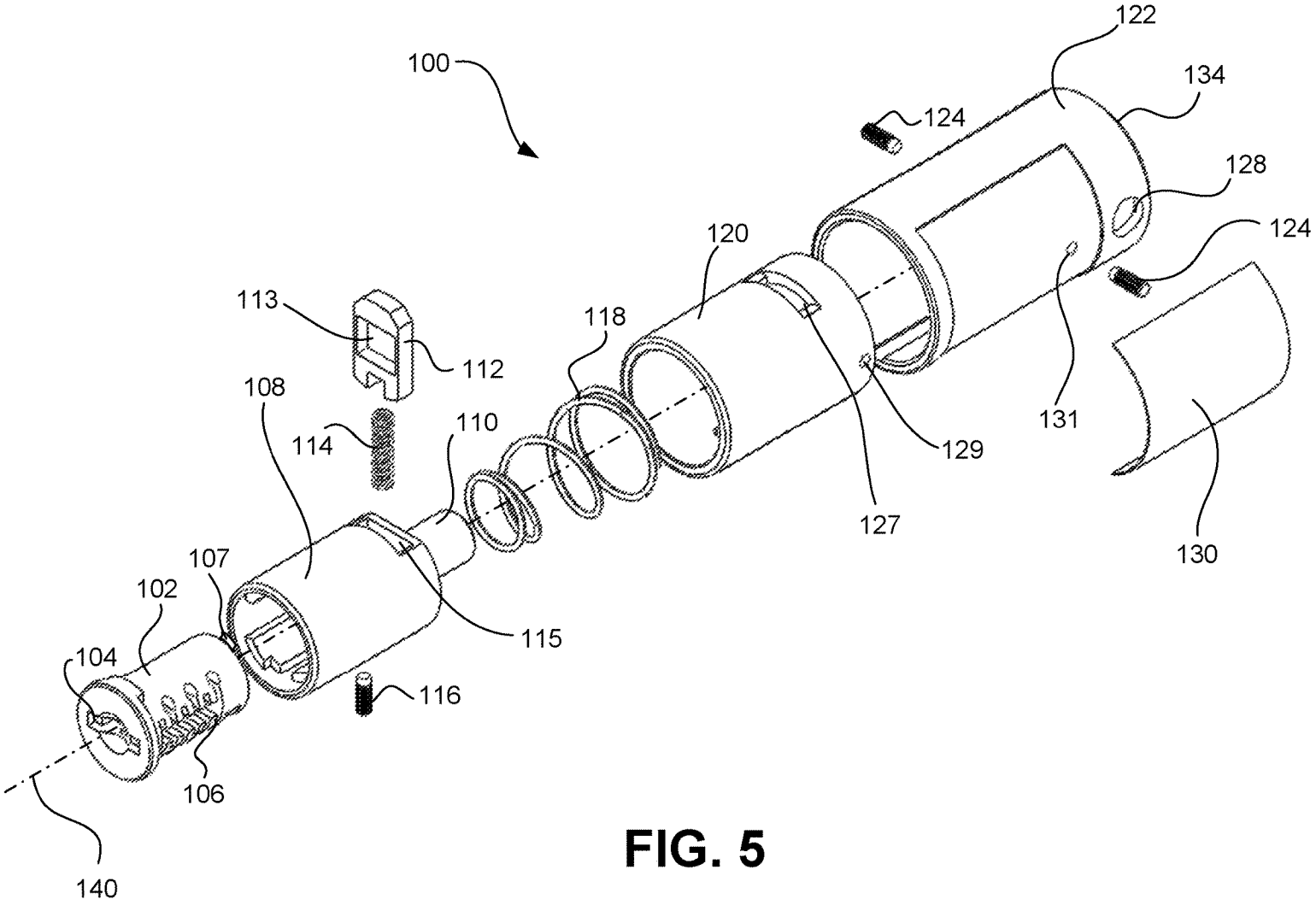
FIG. 5 is an exploded bottom perspective view of the locking device of FIG. 2 in accordance with an embodiment of the present disclosure.

Referring to FIGS. 2-5, a locking device 100 for a single wire peg hook is illustrated, where FIG. 2 is a perspective view of the locking device 100, FIG. 3 is a view with the locking device 100 coupled to peg hook 10, FIG. 4 is an exploded top view of the locking device 100, and FIG. 5 is an exploded bottom view of the locking device 100. The locking device 100 includes a cylinder plug 102, which includes a key hole 104, an arced channel 105 on an end opposite the key hole 104, and a plurality of tumblers 106. It is to be appreciated that the cylinder plug 102 may take forms other than that shown in figures, for example, the cylinder plug 102 may be an electronic cylinder core, a small format interchangeable core (SFIC), etc. The cylinder plug 102 is disposed in a cylindrical shell 108 and retained therein by barrel pin 116. A longitudinal axis 140 of the cylinder plug 102 may be aligned with a longitudinal axis of the cylindrical shell 108. Barrel pin 116 is disposed in an aperture 117 through a wall of the cylindrical shell 108 in such a manner that the barrel pin 116 projects from both sides of the wall of the cylindrical shell 108. On the inner portion of the wall of the cylindrical shell 108, the barrel pin 116 extends into arced channel 105 of the cylinder plug 102 to rotatably retain the cylinder plug 102 in the cylindrical shell 108.

A plunger locking bolt 112 and bolt spring 114 are disposed in slot 115 of cylindrical shell 108. Bolt spring 114 biases the plunger locking bolt 112 outwardly. Depending on a key position in the key hole 104 of the locking device 100, the plunger locking bolt 112 may be positioned in a "locked" or "unlocked" position. The cylindrical shell 108 includes a cylindrical projection or plunger 110, the function of which will be described below.

The cylindrical shell 108 is longitudinally aligned with and disposed in an inner body 120. The cylindrical shell 108 is biased away from the inner body 120 by a barrel spring 118. The portion of the barrel pin 116 extending outside the wall of the cylindrical shell 108 rides in an elongated slot 121 in a wall of the inner body 120. The slot 121 controls the longitudinal front to back motion of the cylindrical shell 108 with respect to the inner body 120. When the locking device 100 is locked, the barrel pin 116 will be at the back 123 of the slot 121. When unlocked, the barrel pin 116 will be at the front 125 of the slot 121.

The inner body 120 is further disposed in an outer housing 122 and is retained therein by retaining pins 124 via apertures 131 in the outer housing 122 and apertures 129 in the inner body 120. The outer housing 122 comprises an outer wall and a hollow interior. The outer housing 122 includes a first peg hook aperture 126 (FIG. 4) and a second peg hook aperture 128 (FIG. 5), generally positioned on opposite sides of the outer housing 122 near an end 134 of the outer housing 122. The first and second peg hook apertures 126, 128 define a channel 136 that allows the wire 12 of the peg hook 10 to pass therethrough. Optionally, a sticker 130 may be provided and disposed on the outer housing 122 to provide information to a user and/or consumer.

In use, end 16 of peg hook 10, or other extended wire of another device to be secured, is inserted into one of the apertures 126, 128, through the channel 136, and out the other aperture 126, 128. According to some uses, the peg hook 10 may be inserted until the bend 14 is approximately in the middle of the channel 136 of the outer housing 122. The locking device 100 is actuated (i.e., locked) by pressing the cylindrical shell 108 into the outer housing 122 in the direction of arrow A as shown in FIG. 3, causing the projection 110 to come into contact with the bend 14 of wire 12. Internally, bolt spring 114 biases plunger locking bolt 112 into slot 127 of the inner body 120. In this manner, the locking device 100 is securely locked onto the peg hook 10 preventing removal of any items disposed thereon.

To unlock and remove the locking device 100, a correct key is inserted into the key hole 104 releasing cylindrical shell 108, which is forced away from the outer housing 122 via the barrel spring 118. When the correct key is inserted into the key hole 104, the tumblers 106 are engaged to create a "shear line" to allow the cylindrical plug 102 to rotate clockwise. An engaging element 107 protruding from a rear portion of the cylindrical plug 102 engages an aperture 113 of the spring-loaded plunger locking bolt 112 as the cylindrical plug 102 is rotated, pulling the plunger locking bolt 112 inward. Upon being driven inward, the plunger locking bolt 112 disengages from the slot 127 of the inner body 120 and barrel spring 118 pushes the cylindrical shell 108 out, thereby disengaging the projection 110 from the wire 12, peg hook, or strike plate inserted through the aperture 126, 128 in the outer housing 122 to allow the lock to be removed to access the merchandise. In some embodiments, the locking device 100 may be used with any wire 12, peg hook, strike plate, and any device with an extending wire arm, with or without a bend in the wire. The locking device 100 may be configured to clamp the side of the wire, either at a straight section or bent section of the wire.

Figure 6:
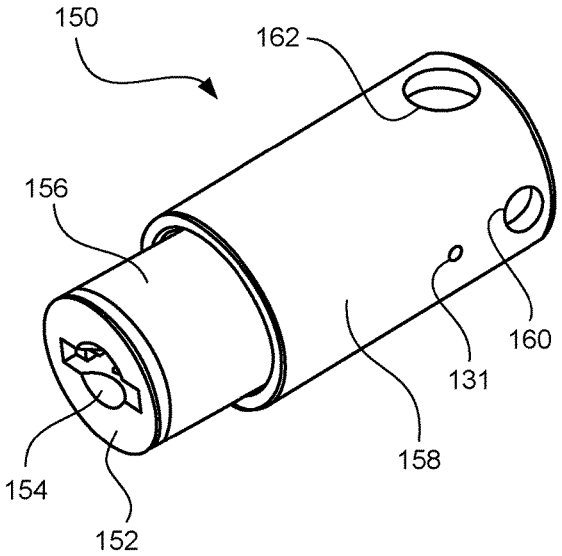
FIG. 6 is a perspective view of a locking device for securing a single wire peg hook in accordance with another embodiment of the present disclosure.
Figure 7:
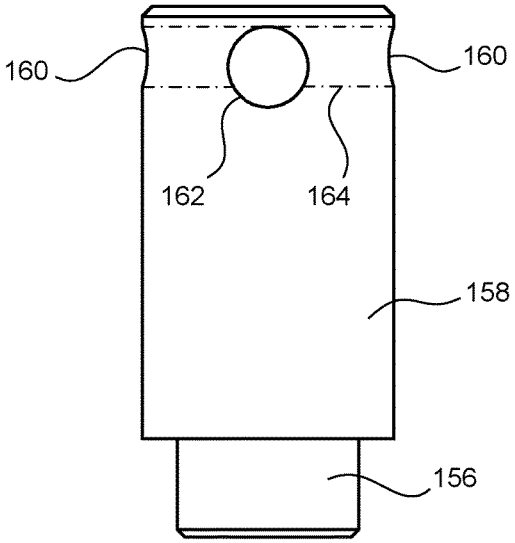
FIG. 7 is a first side view of the locking device of FIG. 6 in accordance with an embodiment of the present disclosure.
Figure 8:
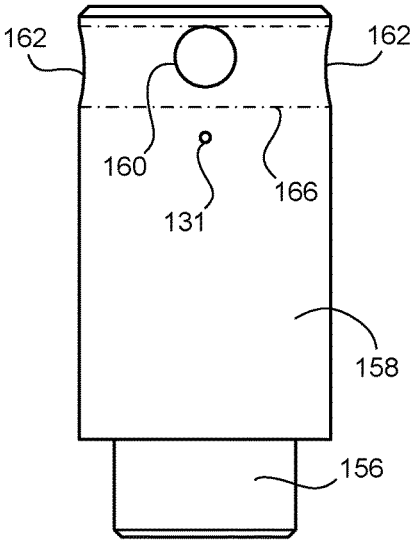
FIG. 8 is a second side view of the locking device of FIG. 6 in accordance with an embodiment of the present disclosure.
Figure 9:
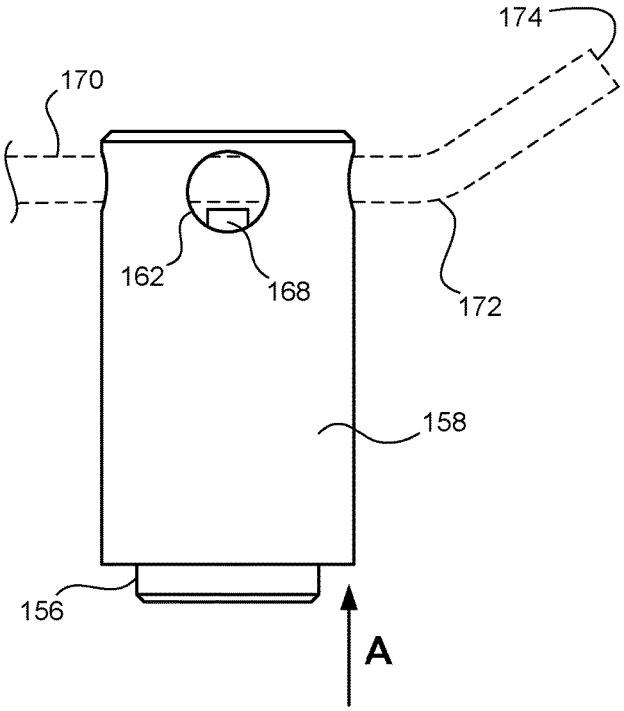
FIG. 9 is the second side view of the locking device of FIG. 6 in use in accordance with an embodiment of the present disclosure.

Referring to FIGS. 6-9, another embodiment of a locking device 150 for securing a wire peg hook is illustrated. FIG. 6 is a perspective view of the locking device 150; FIG. 7 is a first side view with the locking device 150; FIG. 8 is a second side view of the locking device 150; and FIG. 9 is the second side view with a wire peg hook inserted through a channel of the locking device 150.

The locking device 150 includes a cylinder plug 152, which includes a key hole 154 and a plurality of tumblers (not shown). The cylinder plug 152 is disposed in a cylindrical shell 156 and the cylindrical shell 156 is slidably disposed in an outer housing 158. In some embodiments, the cylindrical shell 156 is disposed in an inner body that is further disposed in the outer housing, such as is described above with respect to locking device 100.

Figure 1A:
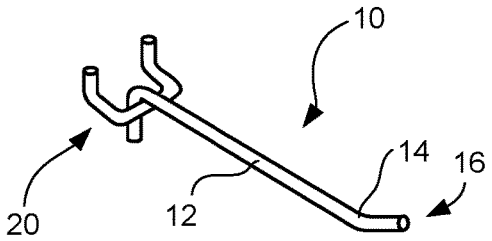
PRIOR ART FIG. 1A
FIG. 1A is a perspective view of a conventional peg hook for displaying products.
Figure 1B:
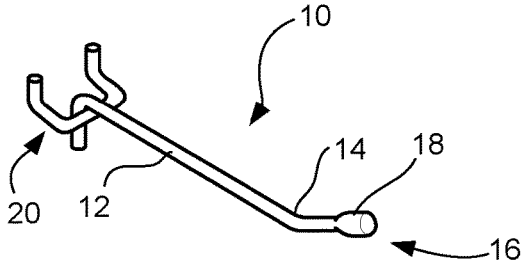
PRIOR ART FIG. 1B
FIG. 1B is a perspective view of a conventional peg hook with a ball tip for displaying products.
Figure 1C:
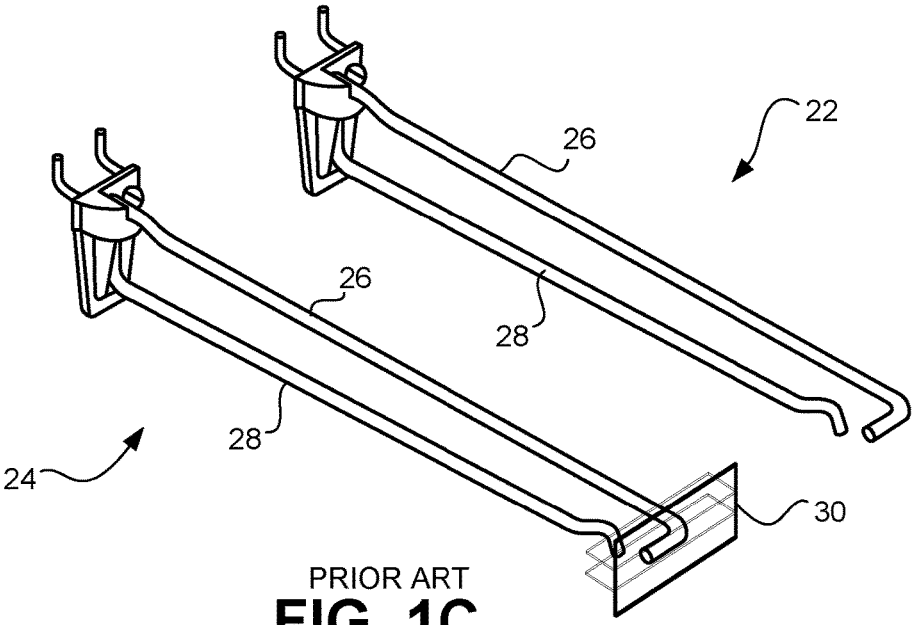
PRIOR ART FIG. 1C
FIG. 1C is a perspective view of conventional peg hooks with an information tag for displaying products.
Figure 1D:
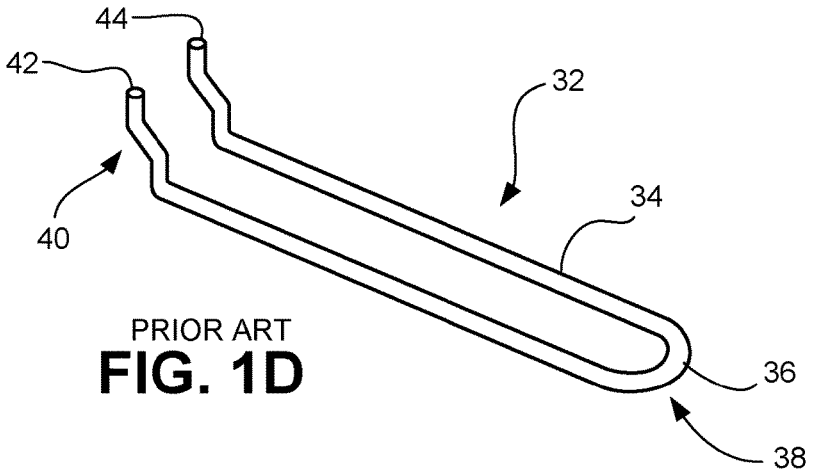
PRIOR ART FIG. 1D
FIG. 1D is a perspective view of a conventional double wire peg hook for displaying products.

The locking device 150 may also include the same or similar internal elements as the elements of locking device 100, the details of which are not being repeated here for the sake of brevity. The difference between the locking devices 100, 150, however, is that the locking device 100 has a single channel and the locking device 150, shown in FIGS. 6-9, includes two intersecting channels. The channels are different sizes to accommodate different sizes of peg hooks or wires. Also, the larger sized channel is configured to accommodate peg hooks with an enlarged ball end, such as ball end 18 shown in FIG. 1B.

The outer housing 158 includes a first pair of peg hook apertures 160 and a second pair of peg hook apertures 162. The peg hook apertures 160 have a smaller diameter than those of peg hook apertures 162. Each pairs of peg hook apertures 160, 162 may be formed on opposite sides of the outer housing 158. The first pair of peg hook apertures 160 defines a first channel 164 (shown in phantom in FIG. 7). The second pair of peg hook apertures 162 defines a second channel 166 (shown in phantom in FIG. 8). The first channel 164 allows a peg hook 170 having a bend 172 to pass therethrough. The second channel 166 allows peg hooks having even larger diameters than the peg hook 170 to pass therethrough.

In use, an end 174 of peg hook 170, or the end of any suitable wire extending from a device to be secured, is inserted into one of the apertures 160, through the channel 164, and out the other aperture 160 on the opposite side of the outer housing 158. The peg hook 170 may be inserted until the bend 172 is approximately in the middle of the channel 164 of the outer housing 158. The locking device 150 is actuated (i.e., locked) by pressing the cylinder plug 152 or cylindrical shell 156 in the direction of arrow A as shown in FIG. 9 such that a projection 168 of the cylindrical shell 156 comes into contact with a straight portion of the peg hook 170 or the bend 172 of the peg hook 170. Internally, a plunger locking bolt (not shown) engages in a slot (not shown) to maintain the projection 168 in the locked position. In this manner, the locking device 150 is securely locked onto the peg hook 170 preventing removal of any items disposed thereon.

To unlock and remove the locking device 150, a correct key is inserted into the key hole 154 releasing cylindrical shell 156, which may be forced away from the channels 164, 166 of the outer housing 158 by a spring. When the cylindrical shell 156 is pushed away from the channels, the projection 168 disengages from the peg hook 170 inserted through one of the channels 164, 166, allowing the locking device 150 to be removed to access the merchandise. In some embodiments, the locking device 150 may be used with any wire, peg hook (e.g., peg hook 170), strike plate, or any device with an extending wire arm, with or without a bend in the wire. The locking device 150 may be configured to clamp the side of the wire, either at a straight section or bent section of the wire.

Figure 10:
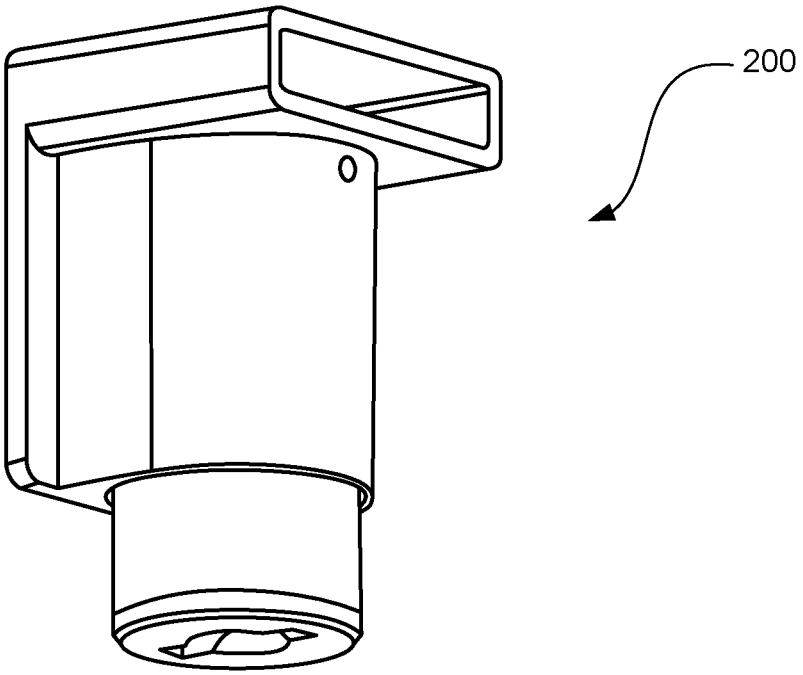
FIG. 10 is a perspective view of a locking device for securing a double wire peg hook in accordance with another embodiment of the present disclosure.
Figure 11:
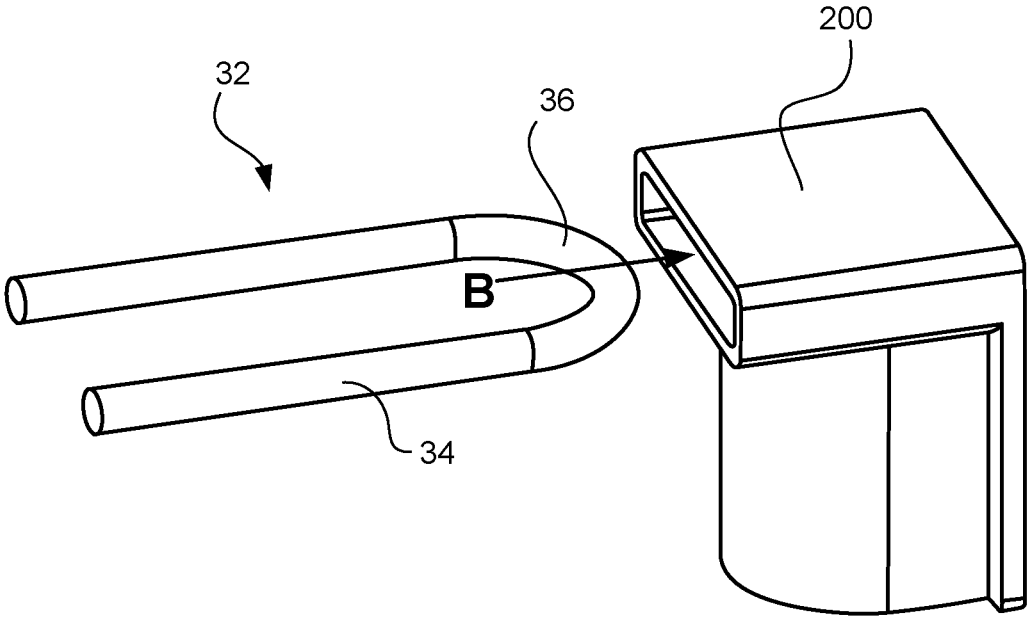
FIG. 11 illustrates the locking device of FIG. 10 being coupled to a double wire peg hook in accordance with an embodiment of the present disclosure.
Figure 12:
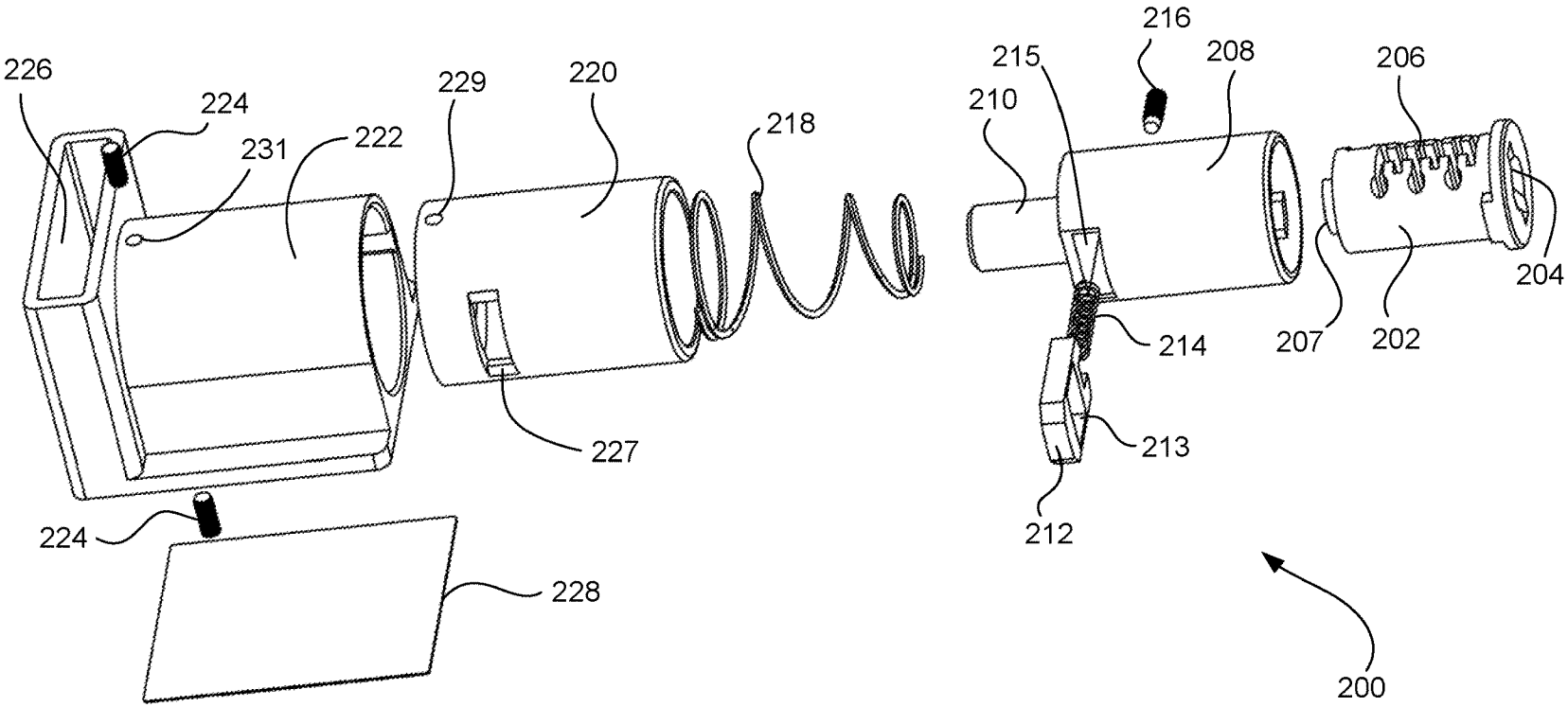
FIG. 12 is an exploded view of the locking device of FIG. 10 in accordance with an embodiment of the present disclosure.
Figure 13:
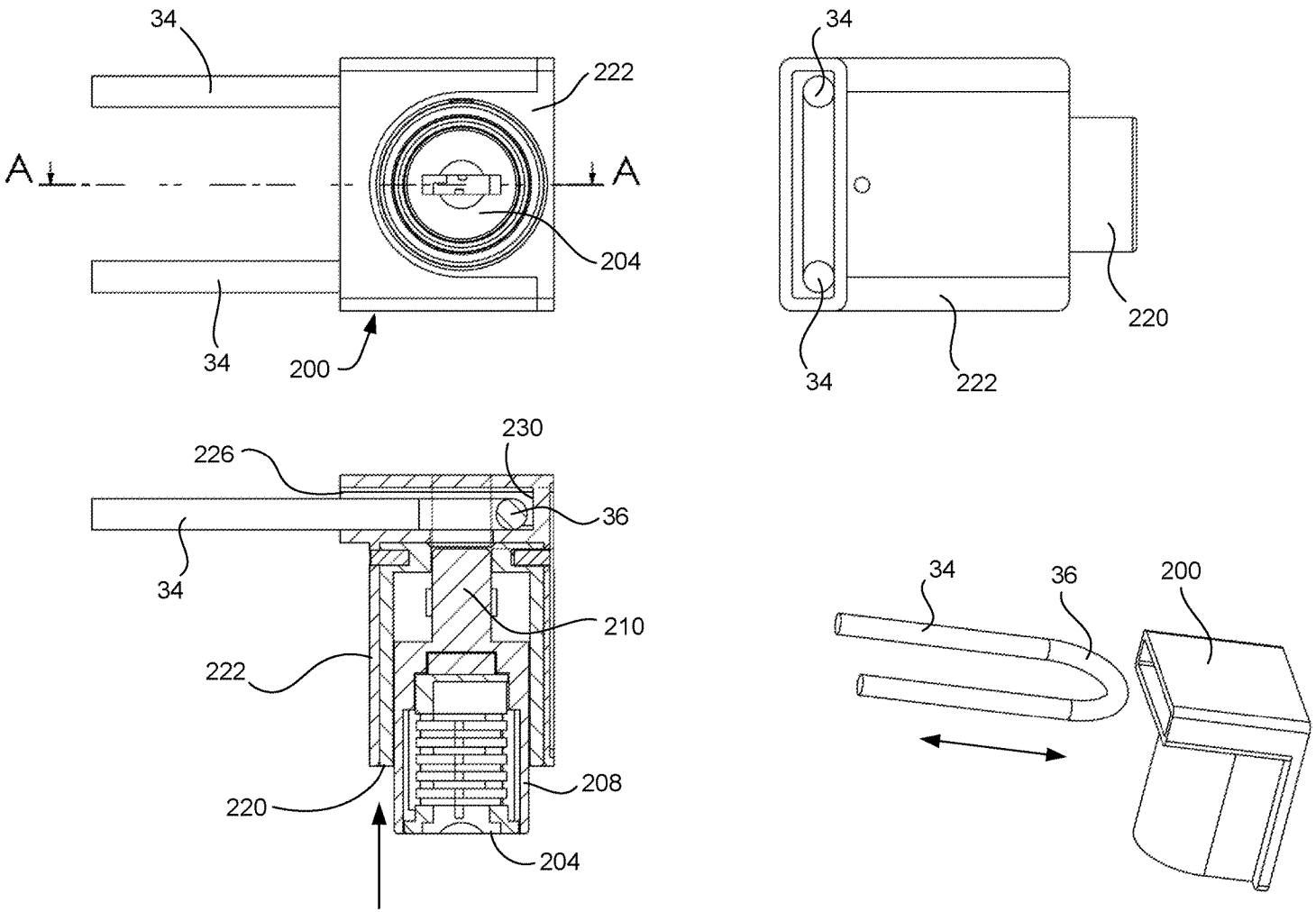
FIG. 13 illustrates various views of the locking device of FIG. 10 in an unlocked state in accordance with an embodiment of the present disclosure.
Figure 14:
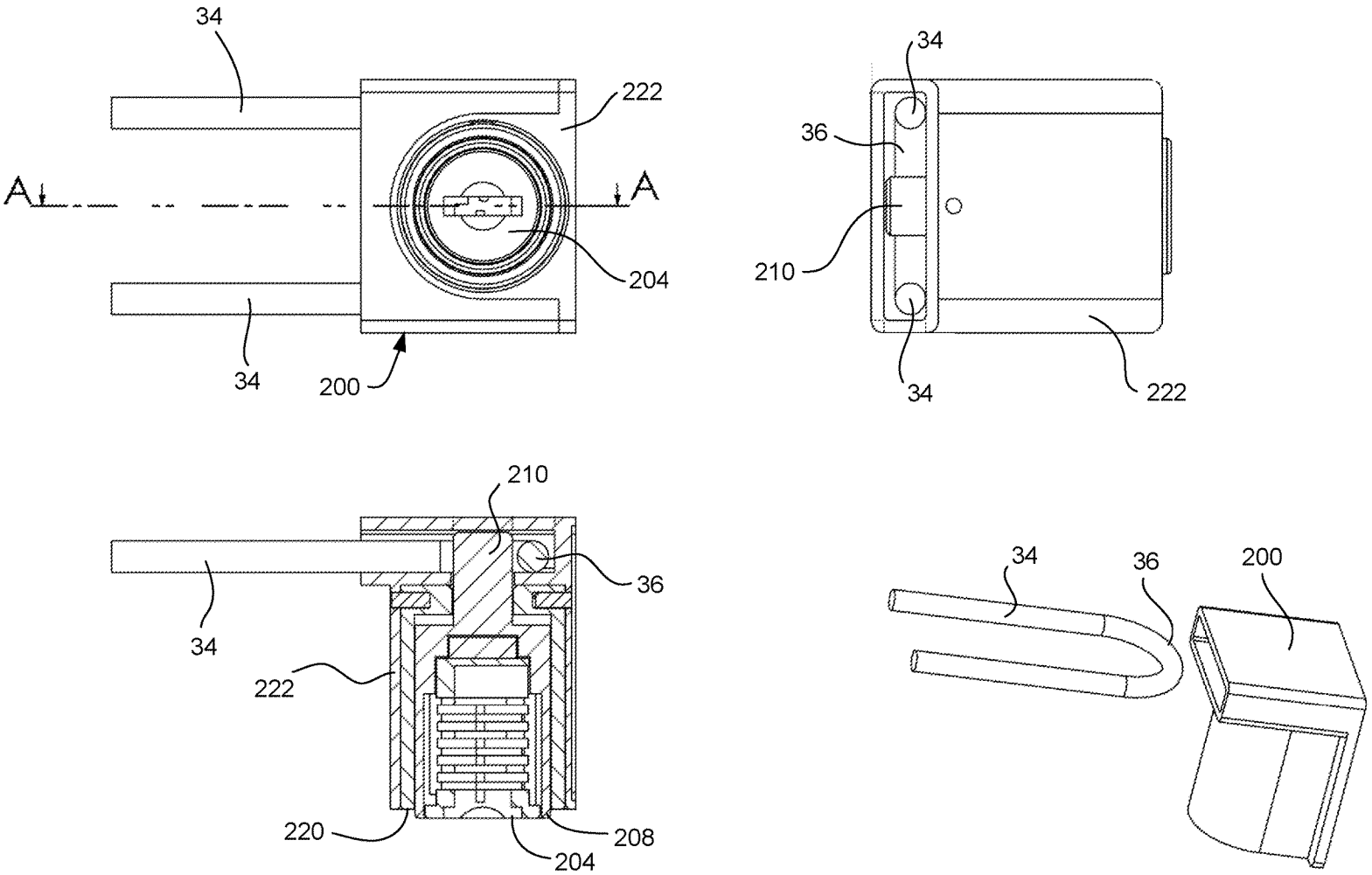
FIG. 14 illustrates various views of the locking device of FIG. 10 in a locked state in accordance with an embodiment of the present disclosure.

Referring to FIGS. 10-14, a locking device 200 for securing a double wire display hook is illustrated. FIG. 10 is a perspective view of the locking device 200; FIG. 11 is a perspective view of the locking device 200 being coupled to a double wire peg hook 32; and FIG. 12 is an exploded view of the locking device 200. FIG. 13 shows various views of the locking device 200 in an unlocked state; and FIG. 14 shows various views of the locking device 200 in a locked state. It is to be appreciated that the locking device 200 uses similar components and functions similar to locking devices 100 and 150. However, locking device 200 includes a different outer housing 222 to interact with different types of peg hooks and strike plates.

The locking device 200 includes a cylinder plug 202 which includes a key hole 204 and a plurality of tumblers 206. The cylinder plug 202 is disposed in a cylindrical shell 208 and retained therein by barrel pin 216. Barrel pin 216 is disposed in aperture (not shown) of the cylindrical shell 208 in such a manner that the barrel pin 216 projects from both sides of the wall of the cylindrical shell 208. On the inner portion of the wall of the cylindrical shell 208, the barrel pin 216 enters a channel (not shown) of the cylinder plug 202 to retain the cylinder plug 202 in the cylindrical shell 208, as described above in relation to locking device 100.

Plunger locking bolt 212 and bolt spring 214 work together to keep the cylindrical shell 208 in the locked position when the plunger locking bolt 212 engages slot 227 in inner body 220. Barrel pin 216 mounted in cylindrical shell 208 rides in an elongated slot (not shown) in inner body 220 to control the longitudinal front to back motion or "throw" of the lock. The barrel pin 216 remains in the most rearward position in the slot when in the unlocked position and is moveable to the most forward position in the slot to be placed in the locked position. The cylindrical shell 208 includes an inner barrel plunger or projection 210, the function of which will be described below.

The cylindrical shell 208 is disposed in the inner body 220 and is biased away from the inner body 220 by a spring 218. The inner body 220 is further disposed in the outer housing 222 and is retained therein by retaining pins 224 via apertures 231 in the outer housing 222 and apertures 229 in the inner body 220. The outer housing 222 includes a slot or aperture 226 to receive the loop 36 of the display hook 32 therein, as indicated by arrow B in FIG. 11. It is to be appreciated that the aperture 226 may receive an end of a strike plate instead of a display hook, as will be described below. Optionally, a sticker 228 may be provided and disposed on the outer housing 222 to provide information to a user and/or consumer.

In use, the loop 36 of display hook 32, as shown in FIG. 13, is inserted into aperture 226 until the loop 36 comes into contact with a rear wall 230 of the outer housing 222 on the opposite end from the aperture 226. The cylindrical shell 208 is then actuated into the outer housing 222, in the direction of arrow C shown in FIG. 13. This actuation causes the projection 210 to enter into an area surrounded by the loop 36 of the display hook 32, as shown in FIG. 14. Internally, bolt spring 214 biases plunger locking bolt 212 into slot 227 of the inner body 220. In this manner, the locking device 200 securely locks onto the display hook 32 preventing removal of any items disposed thereon.

To remove the locking device 200, a correct key is inserted into the key hole 204 releasing cylindrical shell 208, which is forced away from the outer housing 222 via the spring 218. When the key is inserted into the key hole 204, the tumblers 206 are engaged to create a "shear line" to allow cylinder plug 202 to rotate clockwise. An engaging element 207 protruding from a rear portion of the cylinder plug 202 engages with an aperture 213 of the plunger locking bolt 212 driving the plunger locking bolt 212 inward. The plunger locking bolt 212 disengages from the slot 227 of the inner body 220 and spring 218 pushes the cylindrical shell 208 out, thereby disengaging the projection 210 from the peg hook 32 or strike plate inserted through the aperture 226 in the outer housing 222 to allow the lock to be removed to access the merchandise.

Figure 15:
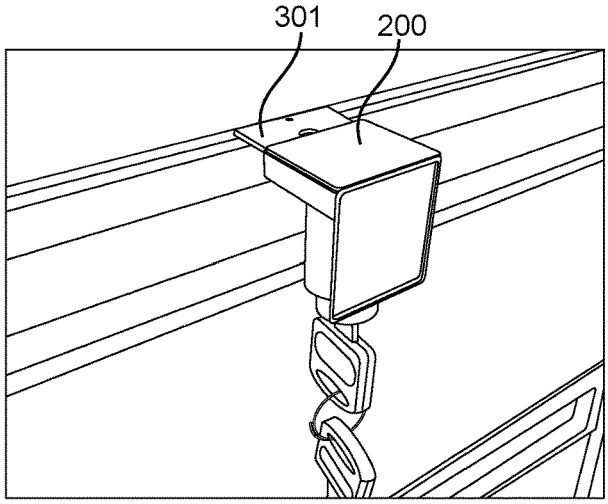
FIG. 15 illustrates a locking device of the present disclosure employed with a locking bracket for use with a drawer of a cabinet.
Figure 16:
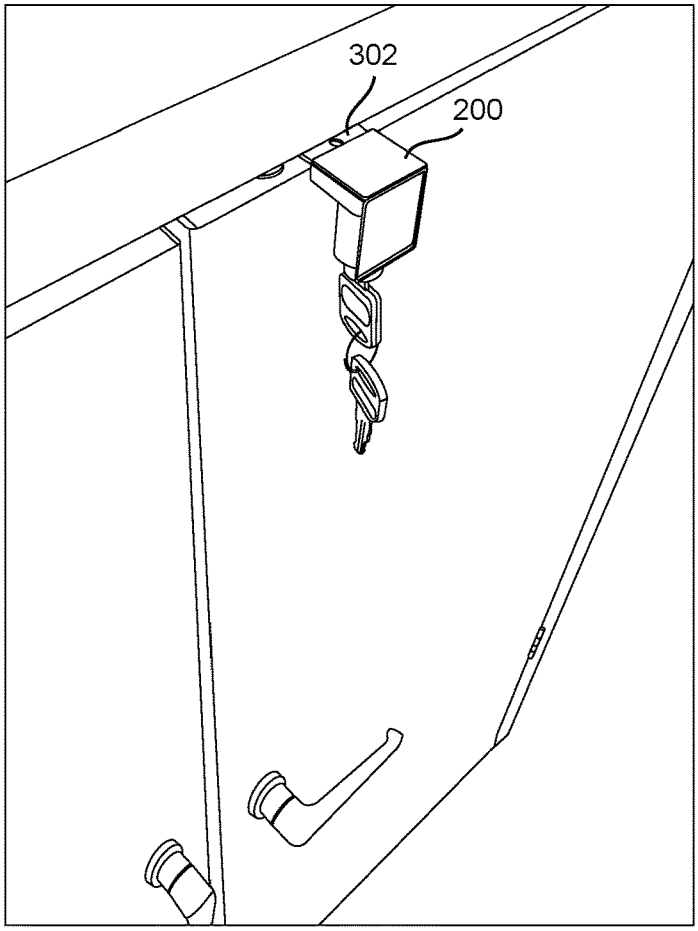
FIG. 16 illustrates a locking device of the present disclosure employed with a locking bracket for use with a door of a cabinet, the locking bracket mounted on the top of the door.
Figure 17:
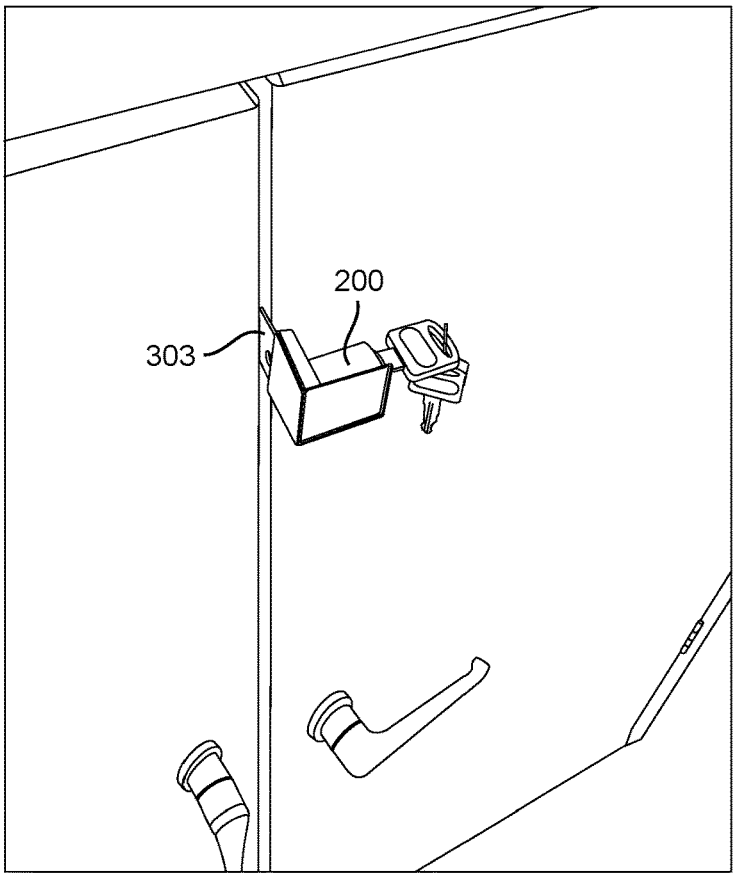
FIG. 17 illustrates a locking device of the present disclosure employed with a locking bracket for use with a door of a cabinet, the locking bracket mounted on the side of the door.
Figure 18:
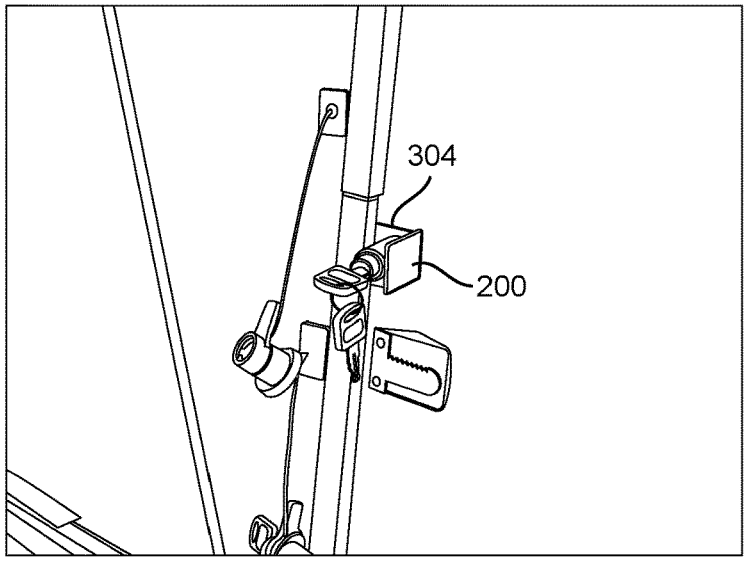
FIG. 18 illustrates a locking device of the present disclosure employed with a locking plate on a sliding door.

Products are also displayed and stored behind doors, drawers, and sliding doors in store fixtures. The locking function of the locking devices 100, 150, 200 of the present disclosure can be extended to any item with a protruding locking pin; e.g., a trailer hitch can use this design to lock down over the pin. For showcase retrofit purposes, being able to add either a locking pin or lockable strike to a showcase that does not have locks enables a lock to be affixed to different doors without the significant cost of labor to drill a mounting hole. Several mounting screws may affix the pins or strikes to allow the plunger lock to prevent the opening of the fixture. For example, FIG. 15 illustrates the locking device 200 of the present disclosure employed with a locking bracket or strike plate 301 for use with a drawer of a cabinet; FIG. 16 illustrates the locking device 200 of the present disclosure employed with a locking bracket 302 for use with a door of a cabinet, the locking bracket 302 mounted on the top of the door; FIG. 17 illustrates the locking device 200 of the present disclosure employed with a locking bracket 303 for use with a door of a cabinet, the locking bracket 303 mounted on the side of the door; and FIG. 18 illustrates the locking device 200 of the present disclosure employed with a locking plate 304 on a sliding door.

Figure 19:
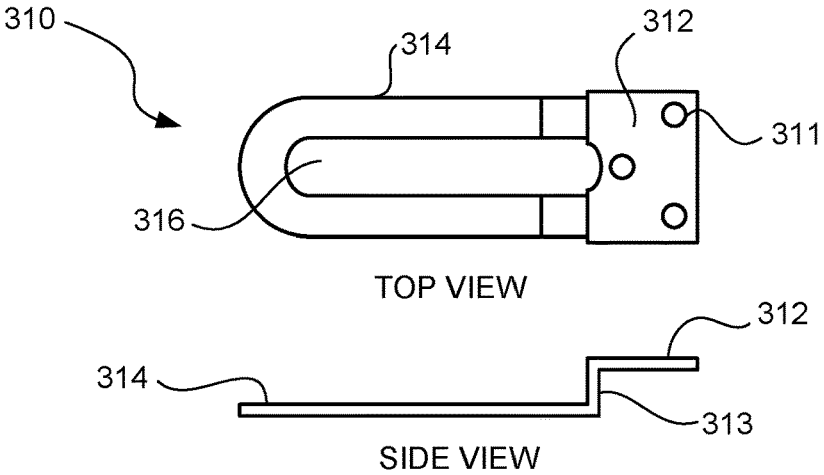
FIG. 19 illustrates a top view and side view of a strike plate with offset for use with a door or drawer of a cabinet in accordance with an embodiment of the present disclosure.
Figure 20:
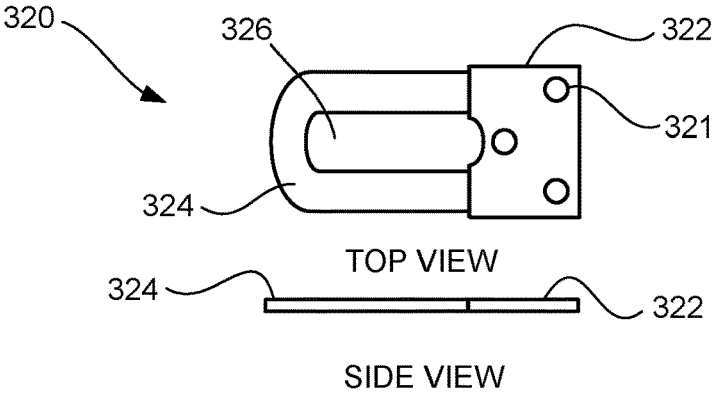
FIG. 20 illustrates a top view and side view of a strike plate with no offset for use with a door or drawer of a cabinet in accordance with an embodiment of the present disclosure.
Figure 21:
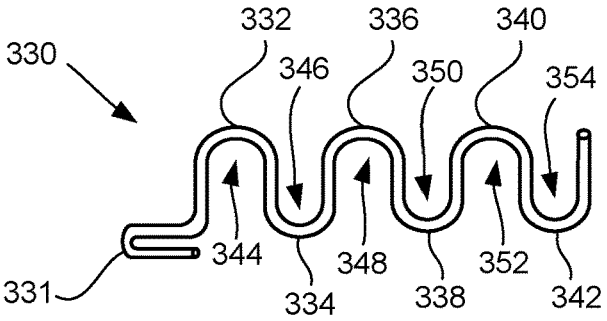
FIG. 21 illustrates a locking bar for use with a sliding glass door in accordance with an embodiment of the present disclosure.

Referring to FIGS. 19-21, various types of locking brackets or strike plates are illustrated. For example, a strike plate 310 for use on a door or drawer is illustrated in FIG. 19. The strike plate 310 includes a mounting portion 312 for mounting the strike plate 310 to a fixture or the like via mounting holes 311. The strike plate 310 further includes a receiving portion 314 coupled to the mounting portion 312 by offset 313. In this embodiment, the receiving portion 314 is configured in a U-shape, forming slot 316. In use, the strike plate 310 is mounted to an appropriate fixture, e.g., a cabinet. Upon closing an associated door or drawer of the cabinet, a locking device of the present disclosure, e.g., locking device 200, is employed to secure the door or drawer. Here, the aperture 226 of the locking device 200 is disposed over the receiving portion 314 of the strike plate 310. When the locking device 200 is actuated, the projection 210 enters the slot 316 securing the locking device 200 to the strike plate 310.

FIG. 20 illustrates another embodiment of a strike plate 320. Strike plate 320 functions similar to strike plate 310 but does not include an offset. Strike plate 320 includes a mounting portion 322 (with mounting holes 321) coupled to a receiving portion 324 having a slot 326 to receive, for example, projection 210.

FIG. 21 illustrates a locking bar 330 to be used with glass doors. Bent end 331 of locking bar 330 is secured to a fixture or one of a pair of sliding glass doors. The locking bar 330 includes a plurality of turns 332, 334, 336, 338, 340, 342 configured to receive a locking device of the present disclosure, e.g., locking device 200. Each turn includes an inner portion 344, 346, 348, 350, 352, 354. In use, locking bar 330 is coupled to the fixture or sliding glass door (not shown). The locking device 200 is disposed over the locking bar 330 such that one of the turns 332, 334, 336, 338, 340, 342 enters the aperture 226 of the locking device 200. The projection 210 of the locking device 200 is then actuated into a locking position, where the projection 210 enters the area defined by the inner portion 344, 346, 348, 350, 352, 354 of the corresponding turn, securing the locking device 200 to the locking bar 330. In addition to strike plates 310, 320 and locking bar 330, the locking device 200 may be configured to lock onto any device having an extending wire hook or loop of an appropriate size to fit into aperture 226.

It is to be appreciated that the various features shown and described are interchangeable, that is, a feature shown in one embodiment may be incorporated into another embodiment.

It is further to be appreciated that the teachings of the present disclosure may apply to other fixtures not shown or described. For example, a school or gym locker may include two members with aligning holes that would conventionally accept a pad lock to secure the locker. The locking devices of the present disclosure may be adapted so the projection or plunger 110, 210 enters the aligning holes to secure the contents of the locker.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A locking device comprising:

an outer housing including an outer wall and a hollow cylindrical interior, the hollow cylindrical interior having a longitudinal axis, the outer housing further including an opening to the hollow cylindrical interior and a first slot, the first slot of the outer housing extending from at least one aperture in the outer wall to the interior of the outer housing and traversing the longitudinal axis;

an inner body mounted inside the outer housing, the inner body including a first slot;

a shell having a projection, the shell being at least partially disposed through the opening and into the hollow cylindrical interior of the outer housing and longitudinally moveable within the interior of the outer housing, wherein, in a locked position, the projection of the shell is maintained in the first slot of the outer housing;

a cylinder plug including a key hole, tumblers, and an arced channel, the cylinder plug contained within the shell and rotatable relative to the shell when a proper key is inserted in the key hole and rotated; and a barrel pin disposed through a wall of the shell, such that a first portion of the barrel pin projects toward the interior of the shell into the arced channel to rotatably retain the cylinder plug in the shell, and a second portion of the barrel pin projects toward the exterior of the shell into the first slot of the inner body to control the longitudinal motion of the shell.

2. The locking device of claim 1, wherein the first slot of the outer housing is disposed at an end of the outer housing and the opening is disposed at an opposite end of the outer housing.

3. The locking device of claim 2, wherein at least a portion of the first slot of the outer housing extends out perpendicularly past the outer wall of the outer housing.

4. The locking device of claim 3, wherein the first slot of the outer housing is configured in a substantially rectangular shape.

5. The locking device of claim 3, wherein the first slot of the outer housing is configured to receive at least a portion of a hook or loop, the at least a portion of the hook or loop having an area surrounded by the hook or loop, and wherein, in the locked position, the projection is maintained in the area surrounded by the hook or loop to secure the hook or loop.

6. The locking device of claim 3, wherein the first slot of the outer housing is configured to receive at least a portion of a strike plate having an aperture, and wherein, in the locked position, the projection is advanced into the aperture to secure the at least a portion of the strike plate in the first slot of the outer housing.

7. The locking device of claim 3, wherein the first slot of the outer housing is configured to receive at least a portion of a locking bar having a plurality of turns, the plurality of turns each including an inner portion defining an area, and wherein, in the locked position, the projection is advanced into the area of the inner portion of one turn of the plurality of turns to secure the locking bar in the first slot of the outer housing.

8. The locking device of claim 1, further comprising a plunger locking bolt movably mounted on the shell, wherein the inner body includes a second slot and the second slot receives the plunger locking bolt to maintain the projection in the locked position.

9. The locking device of claim 8, wherein the shell includes a slot disposed through the wall, wherein the plunger locking bolt is movably mounted through the slot of the shell, such that, the plunger locking bolt moves perpendicularly to the longitudinal axis.

10. The locking device of claim 9, further comprising a bolt spring contained within the interior of the shell, wherein the bolt spring is configured to bias the plunger locking bolt toward the inner body.

11. The locking device of claim 10, wherein the plunger locking bolt includes an aperture and the cylinder plug includes an engaging element, the engaging element disposed in the aperture of the plunger locking bolt, such that, when the cylinder plug is rotated the engaging element is drawn toward the interior of the shell in a direction perpendicular to the longitudinal axis.

12. The locking device of claim 1, further comprising a barrel spring at least partially contained within the hollow cylindrical interior of the outer housing, the barrel spring configured to bias the projection of the shell away from the first slot of the outer housing to an unlocked position.

13. A locking device comprising:

an outer housing including an outer wall and a hollow cylindrical interior, the hollow cylindrical interior having a longitudinal axis, the outer housing further including an opening to the hollow cylindrical interior and a first slot, the first slot of the outer housing extending from at least one aperture in the outer wall to the interior of the outer housing and traversing the longitudinal axis;

an inner body mounted inside the outer housing, the inner body including a first slot and a second slot;

a shell having a projection aligned along the longitudinal axis and an outer wall including a first slot, the shell being at least partially disposed through the opening and into the hollow cylindrical interior of the outer housing and longitudinally moveable within the interior of the outer housing, wherein, in a locked position, the projection of the shell is maintained in the first slot of the outer housing;

a cylinder plug including a key hole, tumblers, and an arced channel, the cylinder plug contained within the shell and rotatable relative to the shell when a proper key is inserted in the key hole and rotated; and a barrel pin disposed through a wall of the shell, such that a first portion of the barrel pin projects toward the interior of the shell into the arced channel to rotatably retain the cylinder plug in the shell, and a second portion of the barrel pin projects toward the exterior of the shell into the first slot of the inner body to control the longitudinal motion of the shell;

a plunger locking bolt movably mounted through the first slot of the shell, such that, the plunger locking bolt moves perpendicularly to the longitudinal axis and the second slot of the inner body receives the plunger locking bolt to maintain the projection in the locked position; and a barrel spring at least partially contained within the hollow cylindrical interior of the outer housing, the barrel spring configured to bias the projection of the shell away from the first slot of the outer housing to an unlocked position.

14. The locking device of claim 13, wherein the first slot of the outer housing is configured in a substantially rectangular shape and is disposed at an end of the outer housing and the opening is disposed at an opposite end of the outer housing.

15. The locking device of claim 14, wherein at least a portion of the first slot of the outer housing extends out perpendicularly past the outer wall of the outer housing.

16. The locking device of claim 15, wherein the first slot of the outer housing is configured to receive at least a portion of at least one of a hook or loop surrounding an area, a strike plate having an aperture, and a locking bar having a plurality of turns and secure the at least a portion in the first slot of the outer housing.

17. A locking device comprising:

an outer housing including an outer wall and a hollow cylindrical interior, the hollow cylindrical interior having a longitudinal axis, the outer housing further including an opening to the hollow cylindrical interior and a first slot, the first slot of the outer housing extending from at least one aperture in the outer wall to the interior of the outer housing and traversing the longitudinal axis;

an inner body mounted inside the outer housing, the inner body including a first slot and a second slot;

a shell having a projection aligned along the longitudinal axis and an outer wall including a first slot, the shell being at least partially disposed through the opening and into the hollow cylindrical interior of the outer housing and longitudinally moveable within the interior of the outer housing, wherein, in a locked position, the projection of the shell is maintained in the first slot of the outer housing;

a cylinder plug including a key hole, tumblers, an arced channel, and an engaging element, the cylinder plug contained within the shell and rotatable relative to the shell when a proper key is inserted in the key hole and rotated;

a barrel pin disposed through a wall of the shell, such that a first portion of the barrel pin projects toward the interior of the shell into the arced channel to rotatably retain the cylinder plug in the shell, and a second portion of the barrel pin projects toward the exterior of the shell into the first slot of the inner body to control the longitudinal motion of the shell;

a plunger locking bolt movably mounted through the first slot of the shell, such that, the plunger locking bolt moves perpendicularly to the longitudinal axis and the second slot of the inner body receives the plunger locking bolt to maintain the projection in the locked position, the plunger locking bolt further including an aperture, wherein the engaging element of the cylinder plug is disposed in the aperture of the plunger locking bolt, such that, when the cylinder plug is rotated the plunger locking bolt is drawn toward the interior of the shell in a direction perpendicular to the longitudinal axis to release the plunger locking bolt from the second slot of the inner body when in the locked position; and a barrel spring at least partially contained within the hollow cylindrical interior of the outer housing, the barrel spring configured to bias the projection of the shell away from the first slot of the outer housing to an unlocked position.

* * * * *